United States Patent [19]

Coberley

[11] Patent Number: 4,574,765

[45] Date of Patent: Mar. 11, 1986

[54] SUPPLEMENTAL AIR INJECTION METHOD AND DEVICES FOR CARBURETORS OF INTERNAL COMBUSTION ENGINES

[75] Inventor: Lavan E. Coberley, Phoenix, Ariz.

[73] Assignee: Donald E. Goorhouse, Lauderhill, Fla.

[21] Appl. No.: 676,881

[22] Filed: Nov. 30, 1984

[51] Int. Cl.[4] ..... F02M 23/00

[52] U.S. Cl. ..... 123/585

[58] Field of Search ..... 123/585–590, 123/26, 25 E, 25 F, 25 G, 25 J, 25 P, 531, 533, 539, 556, 559; 261/30, DIG. 51

[56] References Cited

U.S. PATENT DOCUMENTS

| | | | |
|---|---|---|---|
| 2,789,796 | 4/1957 | Mansfield | 123/539 |
| 2,983,267 | 5/1961 | Percival | 123/559 |
| 3,592,449 | 7/1971 | Elgohary | 261/36 |

FOREIGN PATENT DOCUMENTS 435768 11/1935 United Kingdom .

*Primary Examiner*—William A. Cuchlinski, Jr.
*Attorney, Agent, or Firm*—Warren F. B. Lindsley

[57] ABSTRACT

An air injection device for carburetors which independently supplements the air provided by the usual air filter inputs to the carburetor systems of the internal combustion engines of the modern vehicles.

6 Claims, 5 Drawing Figures

SUPPLEMENTAL AIR INJECTION METHOD AND DEVICES FOR CARBURETORS OF INTERNAL COMBUSTION ENGINES

BACKGROUND OF THE INVENTION

One of the most important parts of an internal combustion engine is its carburetor. Unless the carburetor performs well the engine will not start reliably, will not run smoothly and deliver adequate power and good gasoline mileage, and will produce excessive atmospheric pollutants.

Because the proper operation of the carburetion system is so essential to total engine performance, much attention has been given in the past to carburetor design and over the years the carburetor has become a complex device.

The complexity of the modern carburetor is apparent when it is recognized that the typical carburetor system employs six separate systems, i.e. a float system for controlling the level of fuel in the bowl; a low speed or idling system to provide an adequate fuel supply when air intake is low; a high speed or cruising system to overcome fuel inertia during a sudden increase in power demand; a power system to provide adequate fuel under conditions of reduced vacuum resulting from the opening of the throttle; and a choke system for increasing the fuel-to-air ratio under starting or low temperature conditions.

In addition, there are anti-percolation vents, hot idle compensators, anti-dieseling solenoids and deceleration controls in most modern carburetors.

This multitude of special systems and features requires careful adjustment and maintenance and the many small ducts and valves are vulnerable to blockage and wear by dust and dirt finding their way through the air filter.

Furthermore, until recently there has been a greater emphasis on certain aspects of performance such as starting, acceleration and power developed with insufficient emphasis given to gasoline mileage and atmospheric polluting conditions.

Thus, a need exists for a new approach to carburetion which will produce a better balance in total performance while utilizing a simpler design that does not require the numerous separate systems and special accessories and which provides in particular improved gas mileage and a lower level of atmospheric pollution.

DESCRIPTION OF THE PRIOR ART

British patent No. 435,768 issued Sep. 22, 1935 describes a carburetor design employing a self-adjusting venturi which employs a secondary air supply which under certain operating conditions is fed into the throttle valve.

U.S. Pat. No. 3,592,449 discloses an air valve disposed in the air flowing through a carburetor to the intake manifold of an internal combustion engine. A fuel valve controls the fuel flow to a mixing chamber which produces a suspension of fuel particles which are extrained in the airflow. The air valve is operably connected to the fuel valve through the mixing chamber.

Although most carburetors employ the usual air intake through an air filter and various forms of fuel air mixing devices none have efficiently atomized the gas to fully convert all of its carbon content into burnable fuel so as to increase the gas mileage of the vehicle and effectively reduce the pollutants emitted into the atmosphere from the burning thereof.

SUMMARY OF THE INVENTION

In accordance with the invention claimed, an improved and greatly simplified method and apparatus is provided for effectively atomizing fuel in liquid form to more effectively convert the fuel into useable burnable form for internal combustion engines.

It is, therefore, one object of this invention to provide a new and improved method and device for aerating liquid fuel for internal combustion engine use.

Another object of this invention is to provide a new and improved supplemental air input device for the carburetor systems for internal combustion engines.

A further object of this invention is to provide a new and improved supplemental air input system for carburetors of internal combustion systems which is independent of and in addition to the normal air supply of these carburetors.

A still further object of this invention is to provide a new and improved supplemental air input device for internal combustion systems which is built into the air filter mounted on the top of the carburetors of modern internal combustion engines.

A still further object of this invention is to provide a supplemental air input device for internal combustion engines that injects supplemental fuel atomizing air directly into the venturi portions of the modern day carburetors.

A still further object of this invention is to provide a new and improved device which eliminates the need for accelerating pumps, idle jets, automatic chokes, anti-percolation vents, anti-dieseling solenoids and the like in the most fuel efficient carburetors.

A still further object of this invention is to provide an improved carburetor with effective fuel and air mixing capabilities yielding more finely divided fuel droplets than heretofore possible.

A still further object of this invention is to provide a supplemental air intake for carburetors in which all fuel mixing is accomplished ahead of the throttle plate, thereby realizing a more uniform distribution of fuel throughout the air body.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
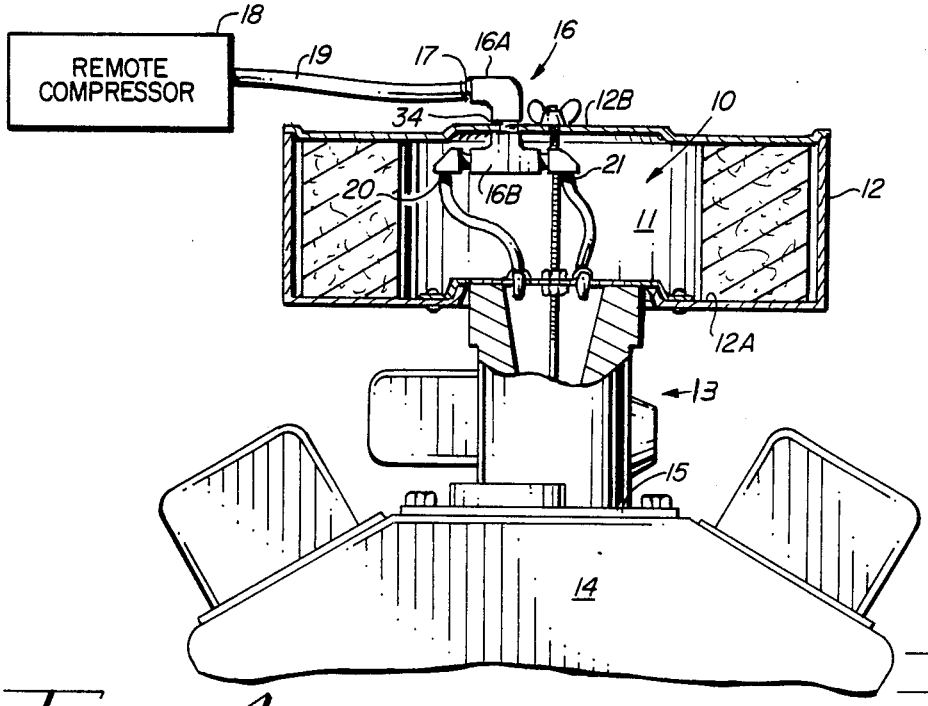
FIG. 1 is a partial diagrammatic view of an air filter and carburetor mounted on an internal combustion engine and embodying the invention.
Figure 2:
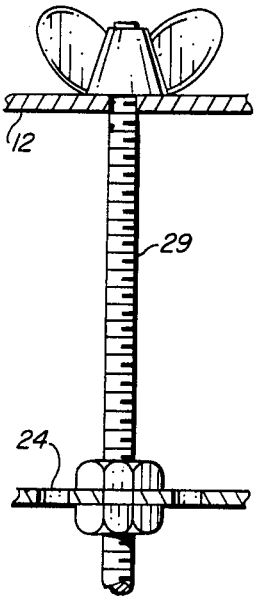
FIG. 2 is an enlarged view of the clamping bolt shown in FIG. 1.
Figure 3:
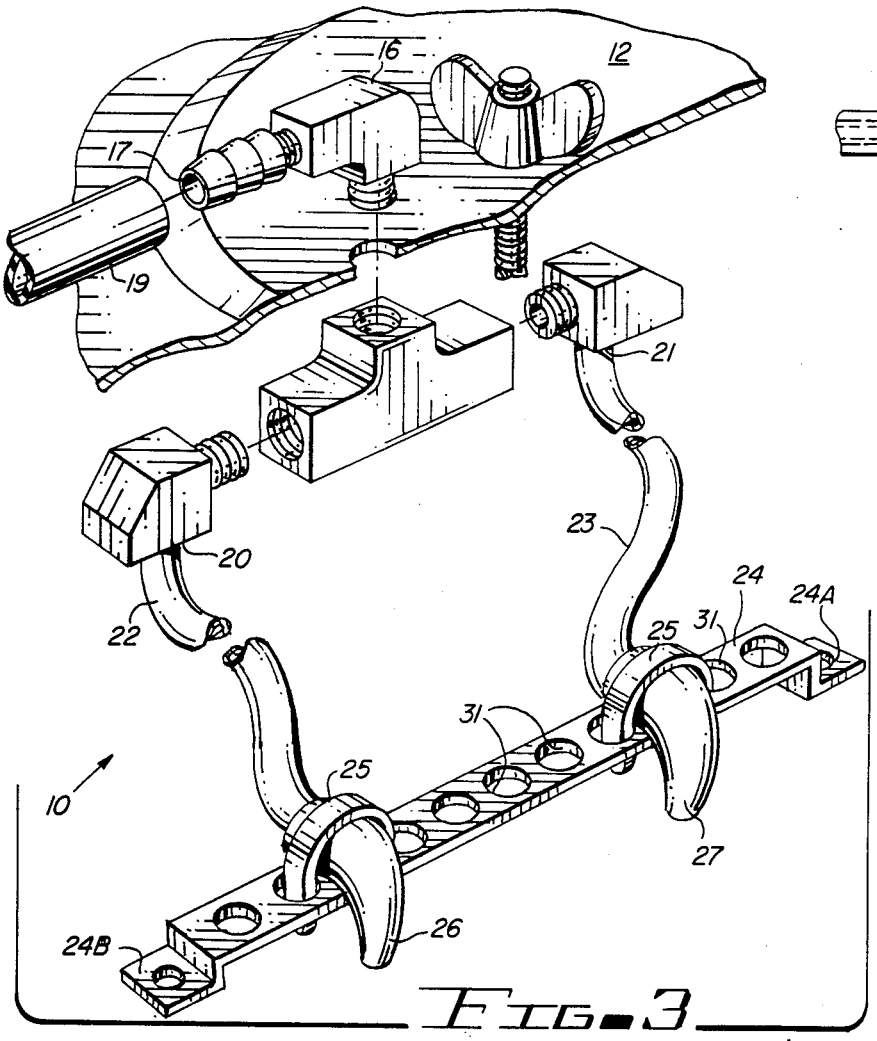
FIG. 3 is an enlarged partial exploded perspective view of the structure shown in FIG. 1 showing in more detail the supplemental air input device.

Referring more particularly to the drawing by characters of reference, FIGS. 1–3 disclose a new and improved supplemental air input device 10 for mounting in the hollow interior 11 of an air filter structure 12 which is mounted on a carburetor 13 of an internal combustion engine 14. As shown, the air filter is directly mounted on the top of the carburetor 13 which is bolted to the intake manifold 15 of engine 14.

The supplemental air input device 10 comprises a coupling 16 comprising an input port 17 which interconnects a remote source of air under pressure such as that received from a compressor 18 through a line 19 and inlet port 17 to one or two outlet ports 20 and 21. It should be noted that only one outlet port 20 may be used for the carburetors of certain internal combustion engines employing a single venturi or two outlet ports for those carburetors employing two or more venturies. For purposes of illustration, the outlet ports 20 and 21 of the supplemental air input device 10 are diagrammatically shown in FIG. 1 as merely feeding into the carburetor 13 but each of the flexible hose mounted nozzle means 22 and 23 connected to the outlet ports 20 and 21, respectively, direct their air under pressure directly into the venturies of the carburetor.

As shown in FIGS. 1 and 3, the nozzle means 22 and 23 are fastened to a suitable apertured supporting clamp 24 by means of fasteners 25. Fasteners 25 partially surround the nozzle means in such a manner that the nozzle heads 26 and 27 of the flexible nozzle means 22 and 23, respectively, may be adjusted to direct the air under pressure passing therethrough directly into the associated venturies of the carburetor.

Figure 4:
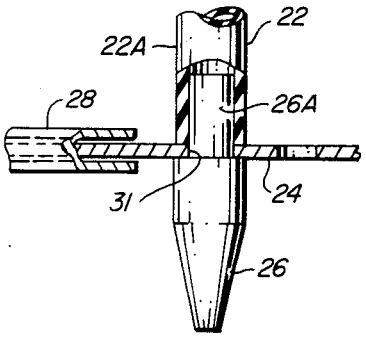
FIG. 4 is an enlarged partial view of a first modification of the nozzle clamping arrangement of the air supplemental device shown in FIGS. 1 and 3.

It should be noted that the center section of clamp 24 may be of a telescopic configuration, as shown by portion 28 of clamp 24 shown in FIG. 4 so that its offset feet 24A and 24B may be selectively clamped to suitable positions on the bottom plate 12A of the air filter structure 12.

As shown in FIG. 2, clamp 24 is adjustably positioned along the length of threaded bolt 29 used for holding the air filter 30 of the air filter structure 12 to the top of the carburetor 13.

Figure 5:
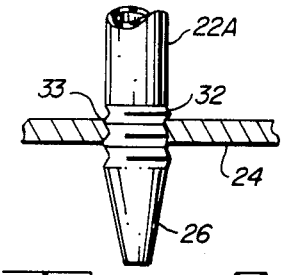
FIG. 5 is an enlarged partial view of a second modification of the nozzle clamping arrangement of the air supplemental device shown in FIGS. 1, 3 and 4.

FIGS. 4 and 5 illustrate modifications of the means for holding and positioning the nozzle means 22 and 23 above the venturies of the carburetor 13.

In FIG. 4 the nozzle head 26 of nozzle means 22 is press fitted into the hose 22A with a neck portion 26A of the nozzle head 26 extending through an aperture 31 of clamp 24 and into hose 22A in the manner shown.

In FIG. 5 the nozzle head 26 of one of the nozzle means is provided with an outside thread 32 for cooperating with suitable inside threads 33 provided along the peripheries of apertures 31 of clamp 24.

It should be noted that the coupling comprises two threadedly connected parts 16A and 16B which are threadedly interconnected through an aperture formed in the top 12B of the air filter structure 12 so that part 16B forming the outlet ports 20 and 21 and nozzle means 22 and 23 are arranged within the air filter 30 of the associated engine 14.

Although but a few embodiments of this present invention have been illustrated and described, it will be apparent to those skilled in the art that various changes and modifications may be made therein without departing from the spirit of the invention or from the scope of the appended claims.

What is claimed is:

1. A supplemental air injection means for carburetors of internal combustion engines comprising:

a coupling provided with an air inlet port for receiving air under pressure and at least one air outlet port for exhausting said air under pressure, a nozzle means comprising a hose connected at one end to said outlet port and a nozzle at the other end of said hose for selectively directing the air under pressure issuing therefrom, and clamp means for selectively positioning said nozzle for directing air under pressure issuing therefrom into the venturi of a carburetor of the associated engine, said clamp means comprising an apertured strip of metal for mounting in an associated air filter of the associated engine for supporting and selectively positioning said nozzle means.

2. The supplemental air injection means set forth in claim 1 wherein:

said coupling comprises two air outlet ports and two nozzle means one connected to each of said outlet ports.

3. The supplemental air injection means set forth in claim 1 in further combination with:

an air compressor connected to said air inlet port for furnishing air under pressure to said coupling.

4. The supplemental air injection means set forth in claim 1 wherein:

said coupling comprises two interconnected parts one part of which forms said outlet port being arranged within a supporting air filter of the associated engine.

5. The supplemental air injection means set forth in claim 1 wherein:

said nozzle means extends through one of said apertures and is supported by said strip.

6. The supplemental air injection means set forth in claim 1 wherein:

said strip comprises a telescopic configuration.

* * * * *